US011133630B2

(12) United States Patent
Zhou et al.

(10) Patent No.: US 11,133,630 B2
(45) Date of Patent: Sep. 28, 2021

(54) LAMP CONNECTOR

(71) Applicant: DONGGUAN THAILIGHT SEMICONDUCTOR LIGHTING CO.,LTD, Dongguan (CN)

(72) Inventors: Wenbo Zhou, Dongguan (CN); Fengqiang Qiu, Dongguan (CN)

(73) Assignee: DONGGUAN THAILIGHT SEMICONDUCTOR LIGHTING CO., LTD., Dongguan (CN)

( * ) Notice: Subject to any disclaimer, the term of this patent is extended or adjusted under 35 U.S.C. 154(b) by 0 days.

(21) Appl. No.: 16/876,155

(22) Filed: May 18, 2020

(65) Prior Publication Data

US 2021/0210914 A1 Jul. 8, 2021

(30) Foreign Application Priority Data

Jan. 2, 2020 (CN) ..... 202010002681.0

(51) Int. Cl.

| | |
|---|---|
| ***H01R 13/627*** | (2006.01) |
| ***H01R 31/06*** | (2006.01) |
| ***H01R 35/00*** | (2006.01) |
| ***H01R 13/512*** | (2006.01) |
| *H01R 13/52* | (2006.01) |
| *H01R 13/621* | (2006.01) |

(52) U.S. Cl.

CPC ..... *H01R 31/06* (2013.01); *H01R 13/512* (2013.01); *H01R 35/00* (2013.01); *H01R 13/5202* (2013.01); *H01R 13/6215* (2013.01)

(58) Field of Classification Search

CPC ..... H01R 13/512; H01R 13/5202; H01R 13/6215; H01R 31/06; H01R 35/00

USPC ..... 439/365

See application file for complete search history.

(56) References Cited

U.S. PATENT DOCUMENTS 3,668,603 A * 6/1972 Burgess ..... F21S 41/198 439/101

3,748,458 A * 7/1973 Morrison ..... B60Q 1/2615 362/267

(Continued)

*Primary Examiner* — Abdullah A Riyami
*Assistant Examiner* — Vladimir Imas

(57) ABSTRACT

The present invention discloses a lamp connector for connecting several lamps each provided with a power cable, a control cable, and female connector terminals, including a connector body, a power cable, a control cable, and male connector terminals, where the male connector terminals match the female connector terminals; receptacles for accommodating the male connector terminals are disposed in the connector body, and one male connector terminal is disposed on both sides of the connector body to connect the connector body to two lamps simultaneously; each of the male connector terminals includes a power cable terminal and a control cable terminal, two ends of the power cable are respectively connected to the two power cable terminals, and two ends of the control cable are respectively connected to the two control cable terminals; and both the power cable and the control cable are disposed in the connector body. According to the present invention, lamps having matched female connector terminals can be connected by simply performing plugging and unplugging operations, without needing a professional to connect cables for the lamps. As such, the operations are simple and quick.

10 Claims, 7 Drawing Sheets

(56) References Cited

U.S. PATENT DOCUMENTS 3,781,755 A * 12/1973 Pitacco ..... B60Q 3/14 439/101
3,805,211 A * 4/1974 Moore ..... H01R 13/20 439/101
3,936,127 A * 2/1976 Morrison ..... H01R 33/46 439/419
4,134,635 A * 1/1979 Roche ..... H01R 23/10 439/135
4,367,417 A * 1/1983 Casasanta ..... F21V 23/06 174/491
4,380,792 A * 4/1983 Terrell ..... F21V 21/30 362/249.1
4,399,371 A * 8/1983 Ziff ..... H02G 3/00 307/147
4,733,335 A * 3/1988 Serizawa ..... B60Q 1/56 362/503
5,198,962 A * 3/1993 Tyson ..... F21S 8/022 174/539
5,205,632 A * 4/1993 Crinion ..... F21S 8/00 362/223
5,306,173 A * 4/1994 Suzuki ..... H01R 33/465 439/336
5,738,435 A * 4/1998 Lin ..... F21V 21/002 362/249.01
5,797,672 A * 8/1998 Dobert ..... B60Q 1/2615 362/190
6,068,384 A * 5/2000 Tyson ..... F21S 8/022 362/153.1
6,132,069 A * 10/2000 Sato ..... F21V 17/14 362/365
6,142,649 A * 11/2000 Beghelli ..... F21S 9/022 362/259
6,238,062 B1 * 5/2001 Hsu ..... F21V 19/006 362/267
7,217,006 B2 * 5/2007 Trenchard ..... F21V 5/045 362/249.02
7,220,014 B2 * 5/2007 Lay ..... F21S 9/022 362/183
7,334,921 B1 * 2/2008 Simnor ..... F21V 21/30 362/249.01
D580,083 S * 11/2008 Sanoner ..... D26/63
7,690,816 B2 * 4/2010 Tyson ..... F21S 8/00 362/294
7,854,616 B2 * 12/2010 Janos ..... F21S 2/00 439/76.1
8,529,110 B2 * 9/2013 Tsukamoto ..... F21S 43/19 362/544
8,872,417 B2 * 10/2014 Fatt ..... H01R 13/6675 313/318.01
9,046,232 B2 * 6/2015 Melzner ..... F21S 2/005
9,188,324 B2 * 11/2015 Jelinek ..... F21K 9/20
10,845,046 B2 * 11/2020 Kohen ..... F21S 8/086
2011/0013395 A1 * 1/2011 Melzner ..... F21V 29/75 362/240
2013/0038851 A1 * 2/2013 Kikuchi ..... H01J 5/54 355/67
2020/0211426 A1 * 7/2020 Tian ..... G09G 3/32
2020/0361262 A1 * 11/2020 Slade ..... H04W 76/14

* cited by examiner

LAMP CONNECTOR

TECHNICAL FIELD

The present invention relates to the field of lamp technologies, and specifically, to a lamp connector.

BACKGROUND

LED lamps can be applied to various scenarios such as indoor lighting for restaurants, shopping malls, and homes and outdoor lighting for parks, stadiums, and mining operations. Therefore, the LED lamps have different power specifications to meet lighting requirements of different occasions.

Conventionally, lamps with different power each are molded integrally, and lamps with different power need to be molded separately. For example, a lamp with power of 100 w and a lamp with power of 200 w need to be manufactured by using two corresponding molds. To meet various lighting requirements (for example, lighting for a small indoor living room and lighting for a large outdoor garden), users need to purchase multiple lamps with different power, and manufacturers and suppliers need to configure lamps with all types of power during production and goods preparation, resulting in very high manufacturing costs and warehousing costs and a great reduction in profits.

Assembling multiple single lamps can meet different lighting requirements to a certain extent. Currently, there are some modular lamps in the industry, mainly including the following types:

(1) Multiple single lamps are fastened together by using only physical connectors (such as metal connecting pieces and bolts), which can multiply lighting effects. However, only physical connection is implemented, power is still supplied to the lamps separately, and multiple power supplies are needed on site. As a result, time-consuming power-on and power-off operations are inevitable, on-site routing of numerous cables is messy, and jointing and assembly/disassembly of the lamps are also troublesome.

(2) Power cables of multiple lamps are connected to implement electrical connection, so that the multiple single lamps are integrated into a modular lamp with the multiple single lamps electrically connected to each other. In this case, power needs to be supplied only to a main power cable led out from the module, and only one power supply is needed on site. This modular lamp also has great disadvantages: (1) Cable-connection between the lamps and cable-routing inside the lamps are highly specialized work and need to be completed by a professional, and therefore are difficult for ordinary consumers/users to complete. On one hand, costs of hiring a professional are very high. On the other hand, the ordinary users cannot assemble the lamps by themselves, causing poor user experience. In addition, cable-connection needs to be completed in advance, and almost cannot be performed on a lamp installation site. After the cable-connected modular lamp is sent to the installation site, the users cannot assemble/disassemble the modular lamp again, causing great inconvenience. For example, a user needs 200 w lighting, and a manufacturer needs to hire a professional to connect two 100 w single lamps to form a 200 w modular lamp at relatively high labor costs. If the lighting requirement of the user is reduced to 100 w someday, it is difficult for the user to disassemble the modular lamp. The modular lamp is no more applicable, causing waste and inconvenience. (2) The single lamps are fastened together, and limited by the cable-connection between the lamps, during installation, a lighting range can be adjusted only by changing an installation position, and an angle between the lamps cannot be adjusted flexibly. Consequently, the modular lamp cannot implement wider-range or more concentrated lighting.

SUMMARY

To overcome the disadvantages of the prior art, the present invention aims to provide a lamp connector for connecting single lamps. A power cable and a control cable are disposed in the lamp connector, and male connector terminals are disposed on two ends of the lamp connector. The lamp connector can be directly plug-connected to lamps having matched female connector terminals, so that both physical connection and electrical connection between the lamps are implemented, and the lamps become a modular lamp.

The present invention is implemented by using the following technical solutions:

A lamp connector for connecting several lamps each provided with a power cable, a control cable, and female connector terminals, including a connector body, a power cable, a control cable, and male connector terminals, where the male connector terminals match the female connector terminals; receptacles for accommodating the male connector terminals are disposed in the connector body, and one male connector terminal is disposed on both sides of the connector body to enable the connector body to connect to two lamps simultaneously; each of the male connector terminals includes a power cable terminal and a control cable terminal, two ends of the power cable are respectively connected to the two power cable terminals, and two ends of the control cable are respectively connected to the two control cable terminals; and both the power cable and the control cable are disposed in the connector body.

Further, the connector body includes a first body and a second body, one male connector terminal is disposed on each of the first body and the second body, and the first body and the second body are rotatably connected.

Further, an inside portion of the second body has a cylindrical surface, and an inside portion of the first body has an arc surface adapted to fit the cylindrical surface to rotate; a sleeve groove with a cylindrical surface is further disposed on the inside portion of the second body, an arc-shaped sleeve portion is further disposed on the inside portion of the first body, and the sleeve portion is adapted to fit the sleeve groove to rotate; and an adjustable bolt hole for installing an adjustable bolt is disposed on the sleeve groove, a bolt sliding groove is disposed on the sleeve portion, and the first body and the second body are rotatably fit and are fastened together or released from each other by using the adjustable bolt.

Further, anti-slip stripes at a specific interval are disposed on the periphery of the bolt sliding groove on the sleeve portion.

Further, several angle label stripes are disposed on the sleeve portion, the angle label stripes are located on the outside of the anti-slip stripes, there is a constant angular distance between the angle label stripes, reference stripes are further disposed on the second body, and the reference stripes are disposed on side portions of the angle label stripes.

Further, the lamp connector further includes terminal fasteners, the terminal fasteners are disposed in the receptacles of the connector body, and the male connector terminals are fastened to the terminal fasteners.

Further, positioning rods are further disposed in the receptacles of the connector body, positioning holes for fitting the positioning rods are disposed on the terminal fasteners, and the terminal fasteners are installed inside the receptacles by using the positioning holes.

Further, the lamp connector includes a waterproof stopper, the waterproof stopper is of an integrally molded structure, one end of the waterproof stopper is connected to an end portion of the first body, and the other end of the waterproof stopper is connected to an end portion of the second body.

Further, the lamp connector includes stopper bolts, one end of the waterproof stopper is connected to the end portion of the first body by using one stopper bolt, the other end of the waterproof stopper is connected to the end portion of the second body by using another stopper bolt, and the waterproof stopper and the second body are rotatably connected by tightening or loosening the stopper bolt.

Further, several guide holes are further disposed on the connector body, and fastening bolts for fastening to the lamps are disposed in the guide holes.

Compared with the prior art, the present invention can achieve the following beneficial effects: The male connector terminals connected to the power cable and the control cable are disposed on the lamp connector, so that the lamp connector can be directly plug-connected to lamps having matched female connector terminals. Therefore, both physical connection and electrical connection between multiple lamps can be implemented, and multiple lamp modules with different power can be formed, to meet diversified lighting requirements. Connecting lamps having matched female connector terminals by using the lamp connector provided in the present invention can be completed by simply performing plugging and unplugging operations, without needing a professional to perform cable-connection and cable-routing between the lamps. Therefore, the operations are simple and quick, an ordinary consumer can also fast complete the operations without needing any professional knowledge, and labor costs of hiring a professional for cable-connection are greatly reduced. In addition, cable-connection does not need to be completed for a modular lamp in advance anymore, and it is only necessary to send the lamp and the connector in the present invention to an installation site, to perform on-site assembly based on an actual situation. When a lighting requirement changes, the quantity of lamps can be increased or decreased to meet the requirement, thereby improving universality and use experience.

Figure 1:
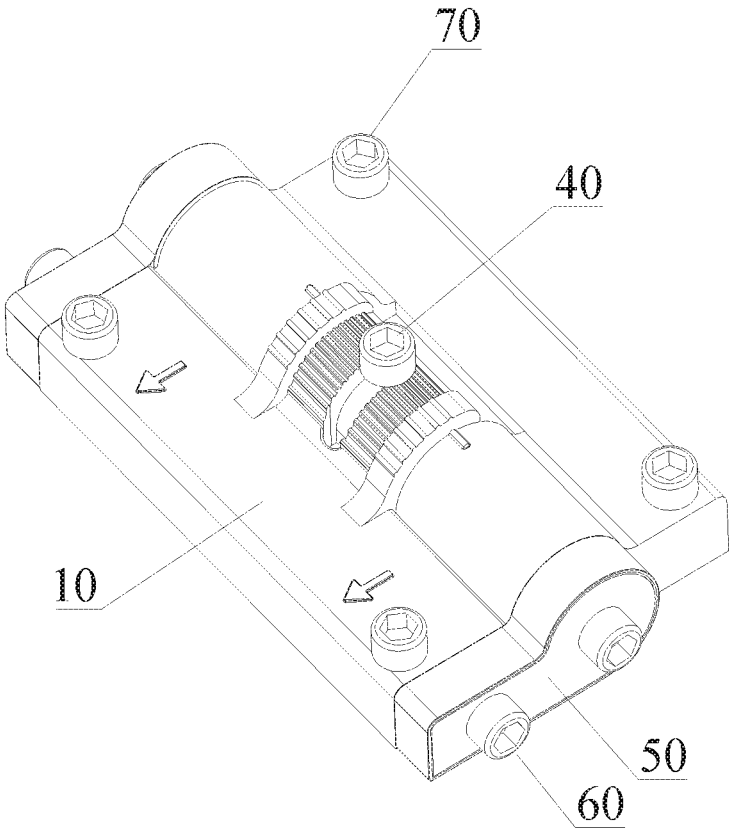
FIG. 1 is a schematic three-dimensional view of a lamp connector.

In the drawings: 10. Connector body; 11. First body; 111. Sleeve portion; 112. Bolt sliding groove; 113. Anti-slip stripe; 114. Angle label stripe; 12. Second body, 121. Sleeve groove; 122. Adjustable bolt hole; 123. Reference stripe; 13. Positioning rod; 20. Male connector terminal; 30. Terminal fastener; 31. Positioning hole; 40. Adjustable bolt; 50. Waterproof stopper; 60. Stopper bolt; 70. Fastening bolt.

DESCRIPTION OF EMBODIMENTS

The following further describes the present invention with reference to the accompanying drawings and specific implementations. It should be noted that, the following described embodiments or technical features may be randomly combined to constitute new embodiments provided that they do not conflict with each other.

The present invention discloses a lamp connector for connecting several lamps to form a modular lamp. The lamp applicable to the present invention needs to be provided with a power cable, a control cable, and female connector terminals, and the female connector terminals of the lamp are connected to the power cable and the control cable inside the lamp.

Figure 2:
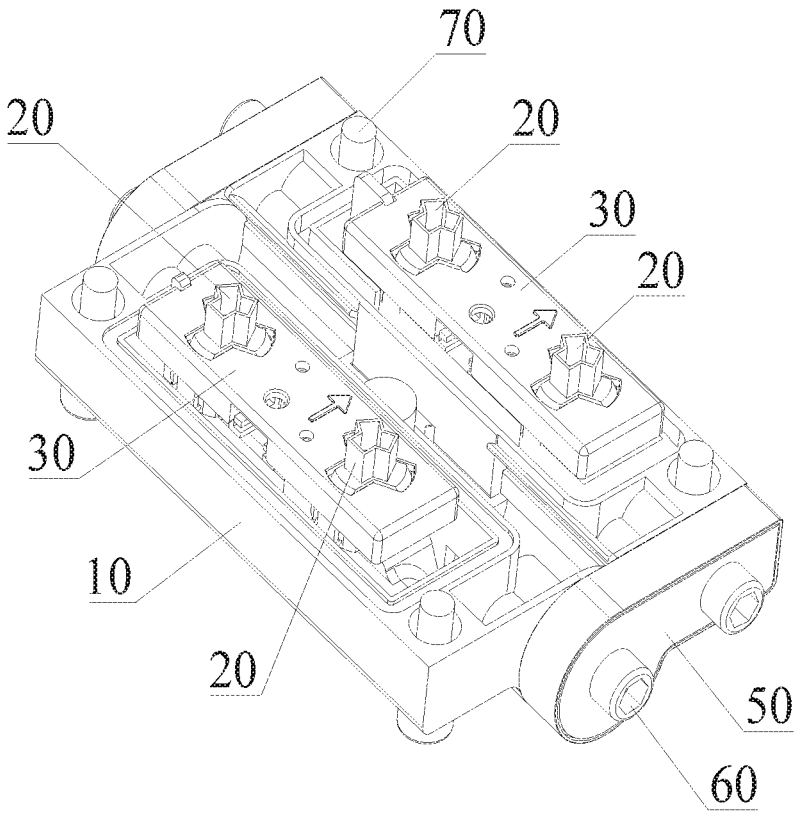
FIG. 2 is another schematic three-dimensional view of a lamp connector.
Figure 3:
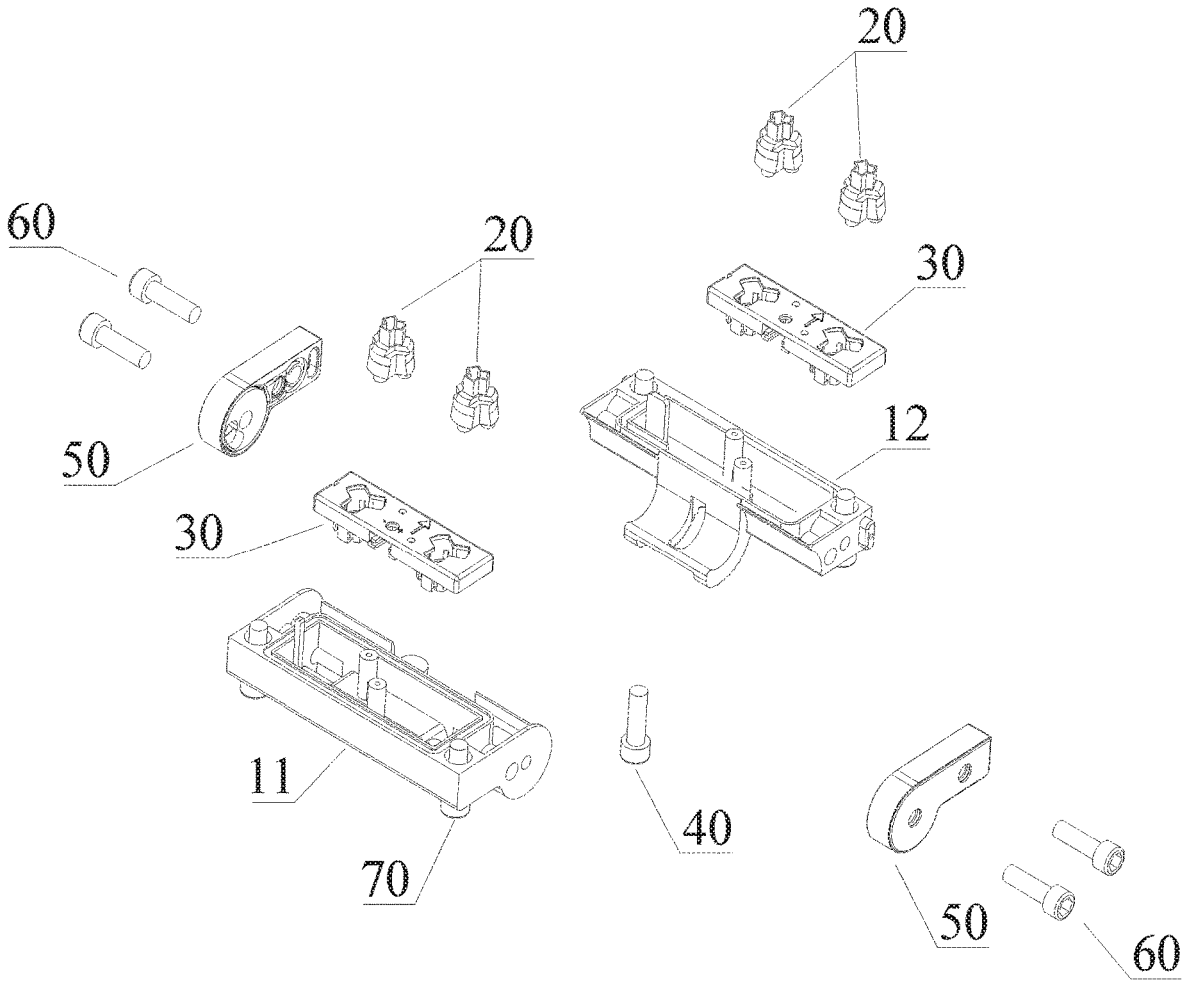
FIG. 3 is an exploded view of a lamp connector.

Referring to FIG. 1 to FIG. 3, the lamp connector provided in the present invention includes a connector body 10, a power cable, a control cable, and male connector terminals 20. The power cable and the control cable of the lamp connector are connected to the male connector terminals 20, and the male connector terminals 20 match the female connector terminals of the lamp. Receptacles for accommodating the male connector terminals 20 are disposed in the connector body 10, and one male connector terminal 20 is disposed on both sides of the connector body 10 to enable the connector body 10 to connect to two lamps simultaneously. Each of the male connector terminals 20 further includes a power cable terminal and a control cable terminal, two ends of the power cable are respectively connected to the two power cable terminals, and two ends of the control cable are respectively connected to the two control cable terminals. That is, the male connector terminals 20 are connected to both the power cable and the control cable. Both the power cable and the control cable (not shown in the figures) are disposed in the connector body 10, and both the cables are not exposed.

The cables are disposed in the lamp connector in the present invention, and both ends of each of the cables are connected to the male connector terminals 20. In addition, the cables inside the lamp are connected to the female connector terminals. Therefore, the lamp and the lamp connector can be electrically connected provided that the male connector terminals 20 of the lamp connector are plug-connected to the female connector terminals of the lamp; and two lamps can be electrically connected via joining by the lamp connector provided that the lamp connector is plug-connected to both the lamps. By analogy, a larger quantity of lamps and a larger quantity of lamp connectors can be used as required to fast assemble multiple modular lamps with different powers.

Figure 5:
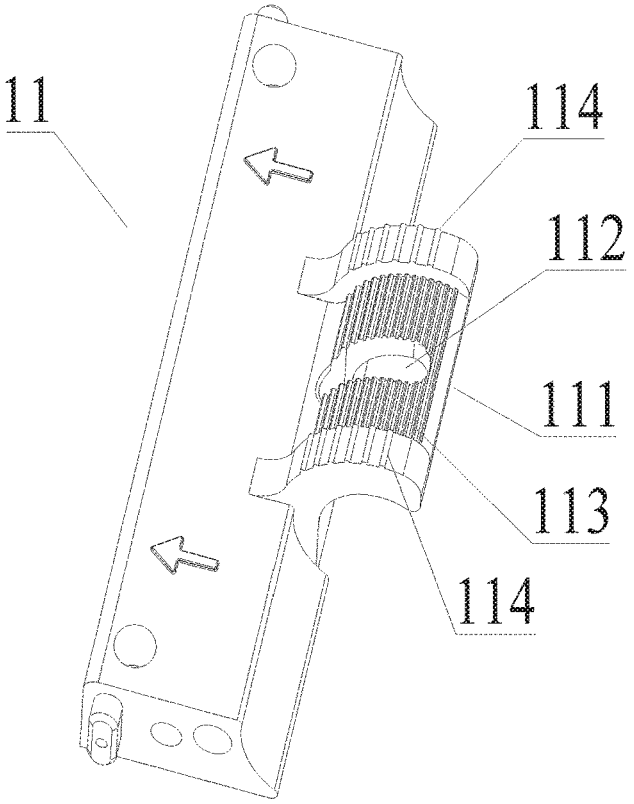
FIG. 5 is a schematic three-dimensional view of a first body.
Figure 6:
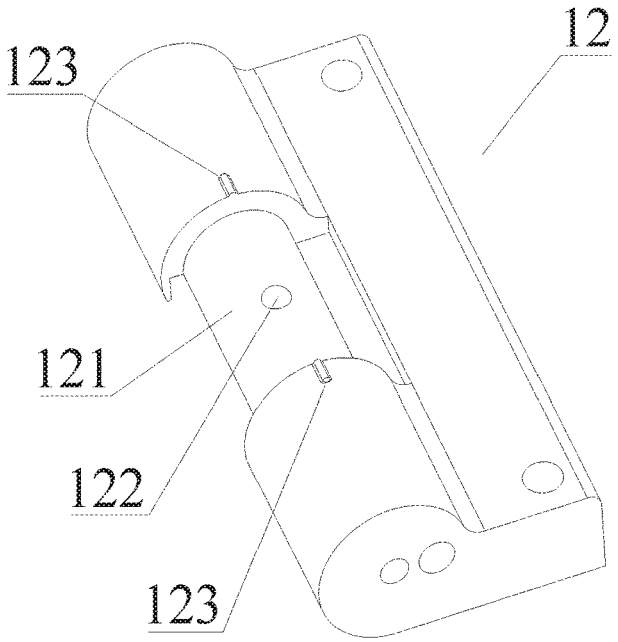
FIG. 6 is a schematic three-dimensional view of a second body.
Figure 7:
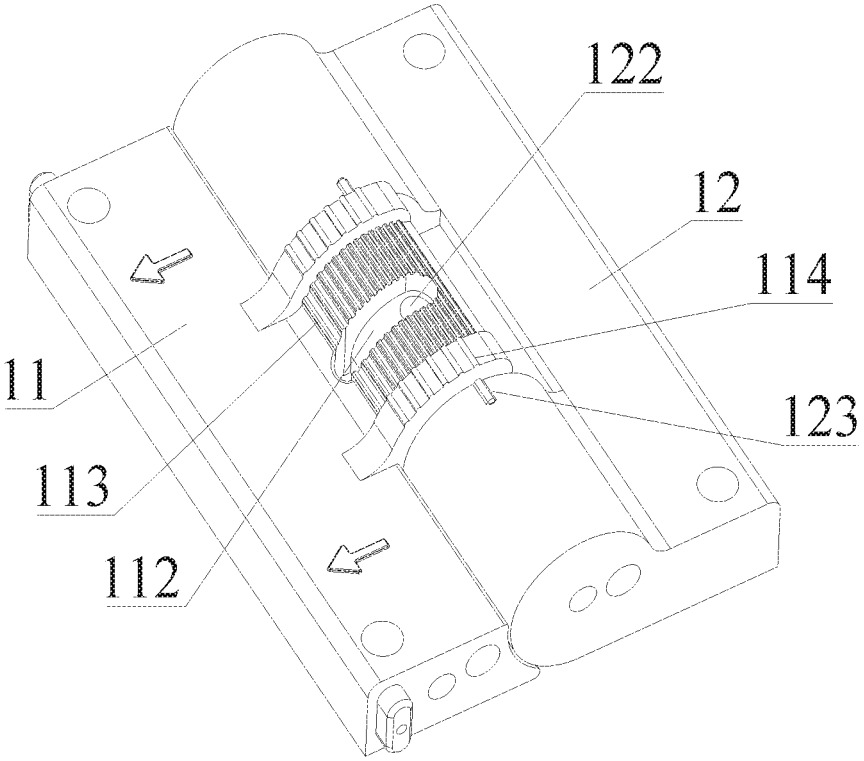
FIG. 7 is a schematic view of a state in which the first body fits the second body.

Specifically, referring to FIG. 5 to FIG. 7, the connector body 10 includes a first body 11 and a second body 12. One male connector terminal 20 is disposed on each of the first body 11 and the second body 12, to connect to one lamp at each end. The first body 11 and the second body 12 are rotatably connected.

More specifically, in this embodiment, an inside portion of the second body 12 has a cylindrical surface, and an inside portion of the first body 11 has an arc surface adapted to fit the cylindrical surface to rotate. In addition, a sleeve groove 121 with a cylindrical surface is disposed on the inside portion of the second body 12, and the sleeve groove 121 is of a groove structure; and an arc-shaped sleeve portion 111 is disposed on the inside portion of the first body 11, and the sleeve portion 111 is of an outward protruding structure. The sleeve portion 111 and the sleeve groove 121 fit each other for rotation. Therefore, the first body 11 and the second body 12 can fit each other for relative rotation by using the foregoing structure. In addition, an adjustable bolt hole 122 for installing an adjustable bolt 40 is disposed on the sleeve groove 121, a bolt sliding groove 112 is disposed on the sleeve portion 111, and the first body 11 and the second body 12 are fastened together or released from each other by using the adjustable bolt 40.

Figure 4:
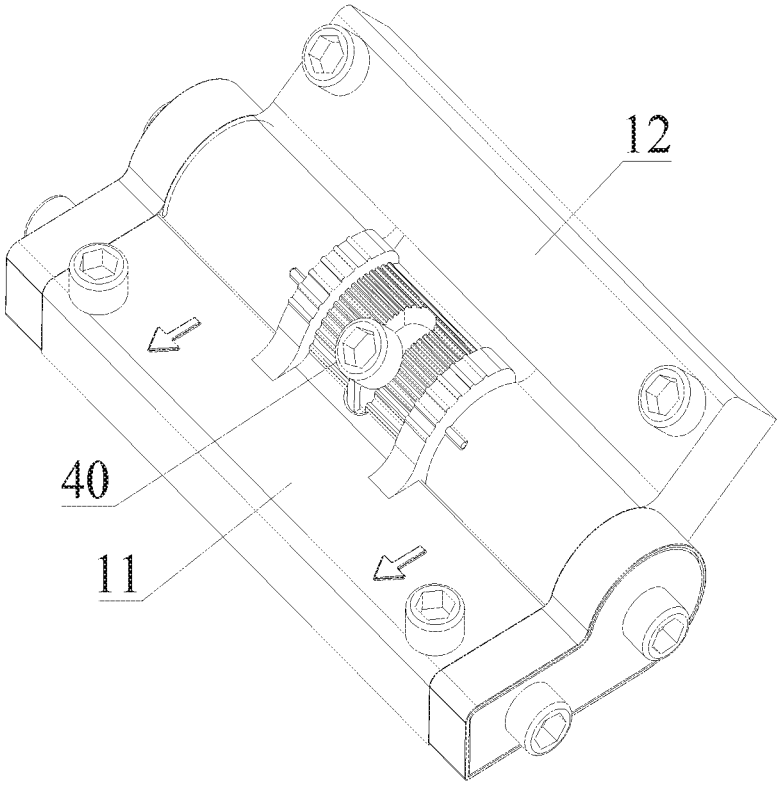
FIG. 4 is a schematic view of a rotation state of a lamp connector.

A rotation function of the lamp connector can be implemented by using the foregoing structure. An angle between different lamps can be flexibly adjusted by adjusting the lamp connector through rotation, to change a lighting range of the entire modular lamp, that is, expand the lighting range, or narrow the lighting range to enhance light concentration. Referring to FIG. 4, when the lamp connector is adjusted through rotation, the adjustable bolt 40 is loosened, and the first body 11 and the second body 12 are rotated to change an angle between the first body 11 and the second body 12. Because the bolt sliding groove 112 is of a long strip structure, the adjustable bolt 40 can move inside the bolt sliding groove 112 during rotation. After a needed angle is formed through adjustment, the adjustable bolt 40 is tightened again to complete angle adjustment.

Certainly, the foregoing rotation structure embodiment is merely one of rotatable connection manners. Alternatively, rotation can be implemented by co-disposing a central rotation shaft in the first body 11 and the second body 12. Alternatively, rotation can be implemented by disposing a component such as a hinge between the first body 11 and the second body 12. Any structure commonly used in the mechanical field to equivalently replace the rotation structure in this embodiment falls within the protection scope of the present invention provided that the same technical effect is achieved.

Specifically, referring to FIG. 5, anti-slip stripes 113 at a specific interval are disposed on the periphery of the bolt sliding groove 112 on the sleeve portion 111, to increase friction after the adjustable bolt 40 is tightened, thereby avoiding unstable fastening due to sliding of the adjustable bolt 40.

Specifically, referring to FIG. 5, angle label stripes 114 are further disposed on the sleeve portion 111. The angle label stripes 114 are located on the outside of the anti-slip stripes 113, and there is a constant angular distance between the angle label stripes 114. Referring to FIG. 6, correspondingly, reference stripes 123 are further disposed on the second body 12, and the reference stripes 123 are disposed on side portions of the angle label stripes 114. Referring to FIG. 7, the reference stripe 123 is used to accurately and visually show a rotation angle of the connector. When the rotation angle of the connector (between the first body 11 and the second body 12) is 0°, the reference stripe 123 is aligned with the outermost angle label stripe 114. There is a constant angular distance between the angle label stripes 114. After the connector is rotated, a current rotation angle can be learned by viewing the reference stripe 123 is aligned with which angle label stripe 114. This is illustrated below by using a specific embodiment.

In an embodiment, there are six angle label stripes 114, and an angular distance between the six angle label stripes is 10°. When the rotation angle of the connector is 0°, the reference stripe 123 is aligned with the first angle label stripe 114 counting from top to bottom. After the connector is rotated, if the reference stripe 123 is aligned with the third angle label stripe 114 in this case, the rotation angle is 10° *(3−1)=20°; and so on.

Certainly, both the quantity of angle label stripes 114 and a value of the angular distance can be changed, and any adjustment correspondingly made based on an actual requirement falls with the protection scope of the present invention.

Figure 9:
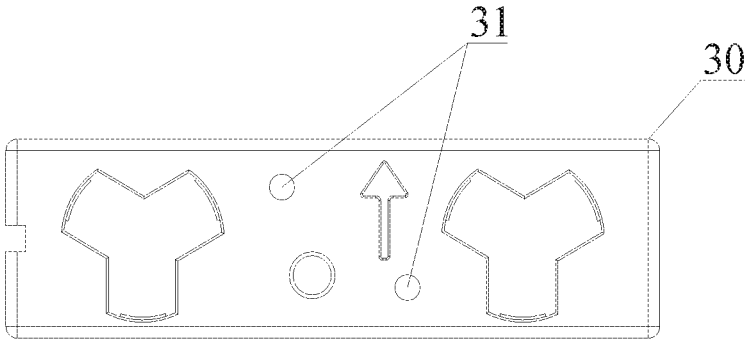
FIG. 9 is a front view of a terminal fastener.

Specifically, referring to FIG. 2 and FIG. 9, the lamp connector further includes terminal fasteners 30. The terminal fasteners 30 are disposed in the receptacles of the connector body 10, the male connector terminals 20 are fastened to the terminal fasteners 30, and the terminal fasteners 30 are fasten and support the male connector terminals 20.

Figure 8:
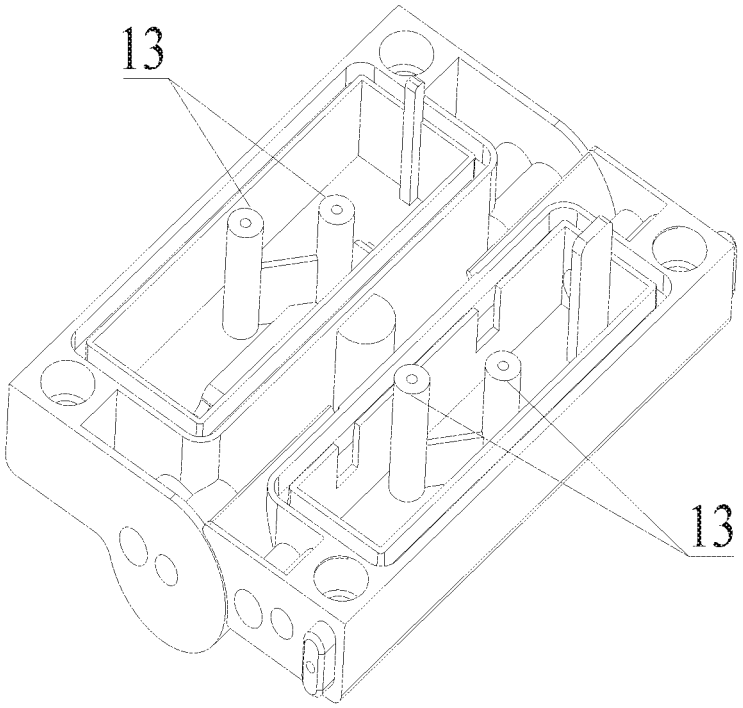
FIG. 8 is another schematic view of a state in which the first body fits the second body.

More specifically, referring to FIG. 8, positioning rods 13 are further disposed in the receptacles of the connector body 10. Referring to FIG. 9, positioning holes 31 for fitting the positioning rods 13 are disposed on the terminal fasteners 30, and the terminal fasteners 30 are installed inside the receptacles via the positioning holes 31 to implement rapid positioning and installation.

Specifically, referring to FIG. 1 to FIG. 3, the lamp connector further includes a waterproof stopper 50. The waterproof stopper 50 is of an integrally molded structure, one end of the waterproof stopper 50 is connected to an end portion of the first body 11, and the other end of the waterproof stopper 50 is connected to an end portion of the second body 12. Because the first body 11 and the second body 12 are rotatably connected, there is a gap between the first body 11 and the second body 12, which allows water or contaminants to enter easily. The waterproof stopper 50 is integrally molded to well block and seal the gap to improve waterproof performance of the lamp connector.

More specifically, the lamp connector further includes stopper bolts 60. One end of the waterproof stopper 50 is connected to the end portion of the first body 11 by using one stopper bolt 60; and the other end of the waterproof stopper 50 is connected to the end portion of the second body 12 by using another stopper bolt 60, and the waterproof stopper 50 and the second body 12 are rotatably connected by tightening or loosening the another stopper bolt 60. In other words, when the rotation angle of the lamp connector is adjusted, the stopper bolt 60 at the second body 12 is loosened, to enable the waterproof stopper 50 to rotate relative to the second body 12. After the rotation angle is adjusted, the stopper bolt 60 is tightened again to fasten both ends of the waterproof stopper 50.

Specifically, referring to FIG. 1, several guide holes are further disposed on the connector body 10, and fastening bolts 70 for fastening to the lamps are disposed in the guide holes. Corresponding fastening bolt holes are disposed on the lamps. After the lamp connector is plug-connected to the lamps, the plug-connection is further enhanced by using the fastening bolts 70, so that the plug-connection is not easy to loosen.

When the lamp connector is in use, first the rotation angle of the lamp connector is adjusted; then the male connector terminals 20 on both ends of the lamp connector are plug-connected to the female connector terminals of the lamps; and finally the lamp connector and the lamps are fastened by using the fastening bolts to implement connection between the lamps. Based on different use requirements, various modular lamps with different power can be constituted by selecting a corresponding quantity of lamps and lamp connectors.

Based on the detailed descriptions of the foregoing embodiments, it can be understood that in the present invention, direct plug-connection to a lamp is implemented through matching between male connector terminals and female connector terminals, so that both physical connection and electrical connection between multiple lamps can be implemented, and multiple light modules with different power are formed to meet diversified lighting requirements. Connecting lamps having matched female connector terminals by using the lamp connector provided in the present invention can be completed by simply performing plugging and unplugging operations, without needing a professional to perform cable-connection and cable-routing between the lamps. Therefore, the operations are simple and quick, an ordinary consumer can also fast complete the operations without needing any professional knowledge, and labor costs of hiring a professional for cable-connection are greatly reduced. In addition, cable-connection does not need to be completed for a modular lamp in advance anymore, and it is only necessary to send the lamp and the connector in the present invention to an installation site, to perform on-site assembly based on an actual situation. When a lighting requirement changes, the quantity of lamps can be increased or decreased to meet the requirement, thereby improving universality and use experience. In addition, the lamp connector has the rotation function, so that an angle between the lamps can be adjusted flexibly, to expand a lighting range of the entire module, or to narrow the lighting range to enhance light concentration, thereby meeting more diversified lighting requirements.

The foregoing implementations are merely preferred implementations of the present invention, and are not intended to limit the protection scope of the present invention. Any non-substantive changes and replacements made by a person skilled in the art based on the present invention fall within the protection scope claimed by the present invention.

What is claimed is:

1. A lamp connector for connecting several lamps each provided with a power cable, a control cable, and female connector terminals, comprising a connector body, a power cable, a control cable, and male connector terminals, wherein the male connector terminals match the female connector terminals; receptacles for accommodating the male connector terminals are disposed in the connector body, and one male connector terminal is disposed on both sides of the connector body to enable the connector body to connect to two lamps simultaneously; each of the male connector terminals comprises a power cable terminal and a control cable terminal, two ends of the power cable are respectively connected to the two power cable terminals, and two ends of the control cable are respectively connected to the two control cable terminals; and both the power cable and the control cable are disposed in the connector body.

2. The lamp connector according to claim 1, wherein the connector body comprises a first body and a second body, one male connector terminal is disposed on each of the first body and the second body, and the first body and the second body are rotatably connected.

3. The lamp connector according to claim 2, wherein an inside portion of the second body has a cylindrical surface, and an inside portion of the first body has an arc surface adapted to fit the cylindrical surface to rotate; a sleeve groove with a cylindrical surface is further disposed on the inside portion of the second body, an arc-shaped sleeve portion is further disposed on the inside portion of the first body, and the sleeve portion is adapted to fit the sleeve groove to rotate; and an adjustable bolt hole for installing an adjustable bolt is disposed on the sleeve groove, a bolt sliding groove is disposed on the sleeve portion, and the first body and the second body are rotatably fit and are fastened together or released from each other by using the adjustable bolt.

4. The lamp connector according to claim 3, wherein anti-slip stripes at a specific interval are disposed on the periphery of the bolt sliding groove on the sleeve portion.

5. The lamp connector according to claim 4, wherein several angle label stripes are further disposed on the sleeve portion, and the angle label stripes are located on the outside of the anti-slip stripes; there is a constant angular distance between the angle label stripes; and reference stripes are further disposed on the second body, and the reference stripes are disposed on side portions of the angle label stripes.

6. The lamp connector according to claim 1, wherein the lamp connector further comprises terminal fasteners, the terminal fasteners are disposed in the receptacles of the connector body, and the male connector terminals are fastened to the terminal fasteners.

7. The lamp connector according to claim 6, wherein positioning rods are further disposed in the receptacles of the connector body, positioning holes for fitting the positioning rods are disposed on the terminal fasteners, and the terminal fasteners are installed inside the receptacles via the positioning holes.

8. The lamp connector according to claim 2, wherein the lamp connector further comprises a waterproof stopper; and the waterproof stopper is of an integrally molded structure, one end of the waterproof stopper is connected to an end portion of the first body, and the other end of the waterproof stopper is connected to an end portion of the second body.

9. The lamp connector according to claim 8, wherein the lamp connector further comprises stopper bolts; one end of the waterproof stopper is connected to the end portion of the first body by using one stopper bolt; and the other end of the waterproof stopper is connected to the end portion of the second body by using another stopper bolt, and the waterproof stopper and the second body are rotatably connected by tightening or loosening the stopper bolt.

10. The lamp connector according to claim 1, wherein several guide holes are further disposed on the connector body, and fastening bolts for fastening to the lamps are disposed in the guide holes.

* * * * *